United States Patent [19]

Peters

[11] Patent Number: 4,708,670

[45] Date of Patent: Nov. 24, 1987

[54] RETRACTABLE TROLLING MOTOR ASSEMBLY

[76] Inventor: Shelby L. Peters, Rte. 4 Box 215A, West Monroe, La. 71291

[21] Appl. No.: 889,233

[22] Filed: Jul. 25, 1986

[51] Int. Cl.[4] ..... B63H 21/26

[52] U.S. Cl. ..... 440/6; 440/59; 248/642

[58] Field of Search ..... 440/6, 7, 53, 55, 58, 440/59, 60, 64; 248/640–643

[56] References Cited

U.S. PATENT DOCUMENTS

| | | | |
|---|---|---|---|
| 2,901,194 | 8/1959 | Shontz | 440/53 |
| 2,928,631 | 3/1960 | Hartman | 440/59 |
| 3,191,573 | 6/1965 | Hixon | 440/59 |
| 3,580,212 | 5/1971 | Fortson | 440/6 |
| 3,948,204 | 4/1976 | Brock et al. | 440/6 |
| 3,948,472 | 4/1976 | Metcalf | 440/53 |
| 3,965,844 | 6/1976 | Brock et al. | 440/6 |
| 3,980,039 | 9/1976 | Henning | 440/60 |
| 4,008,680 | 2/1977 | Alexander | 440/58 |
| 4,175,724 | 11/1979 | Bauman | 440/55 |
| 4,371,144 | 2/1983 | Godlewski | 440/6 |
| 4,555,233 | 11/1985 | Klammer et al. | 440/6 |

*Primary Examiner*—Joseph F. Peters, Jr.
*Assistant Examiner*—Stephen P. Avila
*Attorney, Agent, or Firm*—John M. Harrison

[57] ABSTRACT

A retractable trolling motor assembly which is characterized by a glide track secured to the bow of a boat, a slide bracket slidably attached to the glide track and threaded on a motor-driven drive shaft journaled for rotation in the glide track and a trolling motor bracket pivotally attached to the slide bracket for supporting the shaft of a trolling motor, such that rotation of the drive shaft causes the slide bracket to traverse the glide track and selectively retract the trolling motor into a resting position on the glide track and extend the trolling motor into functional, vertical configuration at the end of the glide track.

18 Claims, 7 Drawing Figures

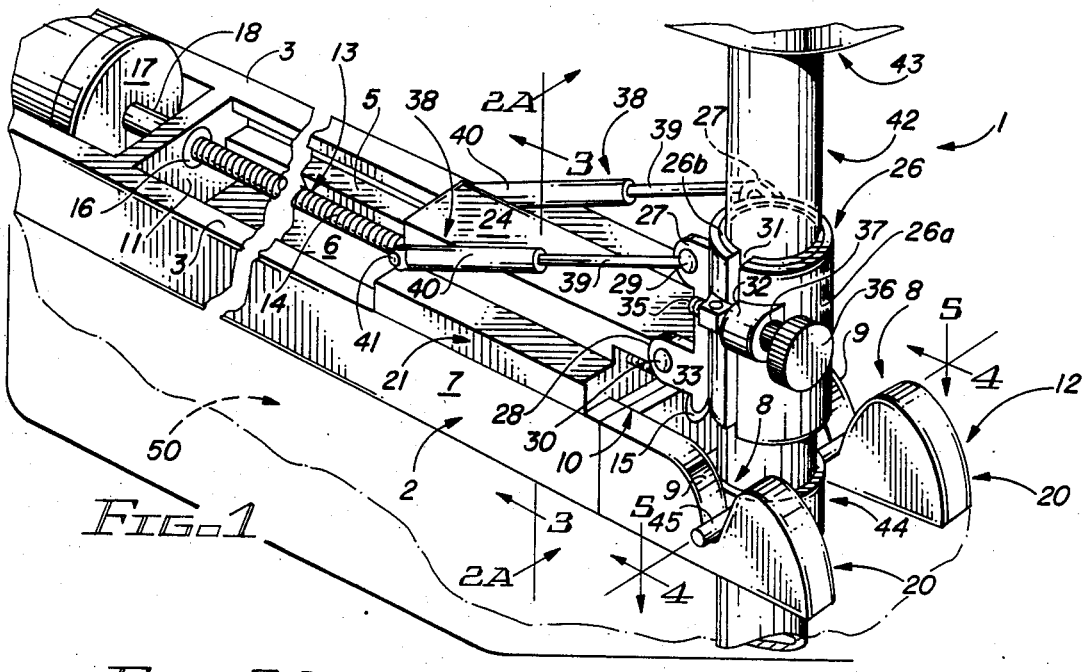
FIG. 1
FIG. 2A
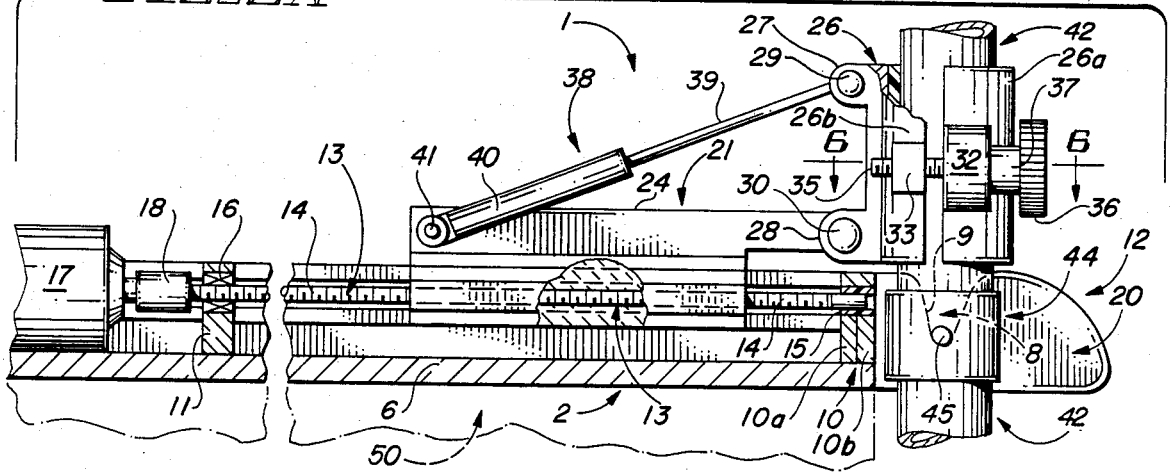
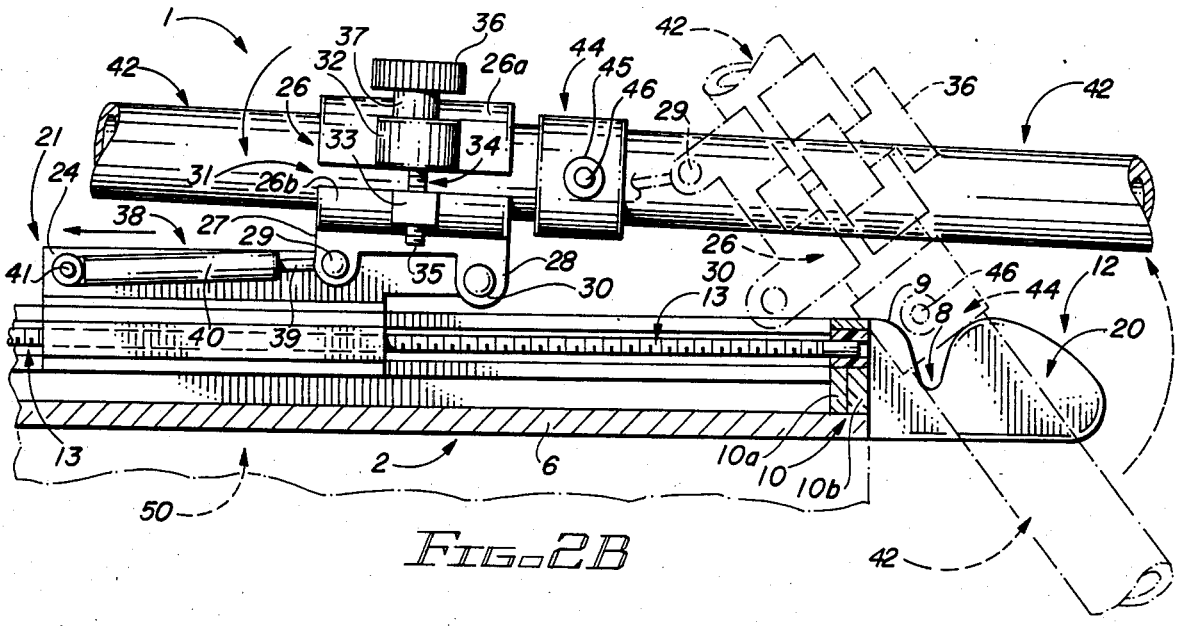
FIG. 2B

RETRACTABLE TROLLING MOTOR ASSEMBLY

BACKGROUND OF THE INVENTION

1. Field of the Invention

This invention relates to electric trolling motors for boats and more particularly, to a retractable trolling motor assembly which is capable of automatically retracting and extending a trolling motor on a glide track mounted to the bow or deck of a boat. The retractable trolling motor assembly is further characterized by a slide bracket slidably mounted on the glide track in cooperation with a drive shaft which is journaled for rotation in the glide track and is threaded in the slide bracket. The drive shaft extends substantially the entire length of the glide track and a trolling motor bracket carrying a trolling motor shaft is pivotally attached to the slide bracket. This mechanical arrangement permits operation of the drive shaft in the clockwise and counterclockwise direction and causes the slide bracket to traverse the drive shaft and the glide track in two directions and selectively retract the trolling motor on the glide track and deploy the trolling motor in vertical, functional orientation at the end of the glide track. A primary feature of the retractable trolling motor assembly of this invention is the ease with which the trolling motor can be deployed forwardly of the bow or deck of the boat and suspended from the glide track in vertical, functional configuration with the propulsion unit located in the water and alternatively, in retracted configuration with the propulsion unit located on the glide track and above the bow or deck of the boat. The retractable trolling motor assembly can be mounted on substantially any conventional boat having a sufficiently flat area or deck in the bow for mounting the glide track and the automatic design of the retractable trolling motor assembly eliminates the requirement for an elaborate folding bracket mechanism which is necessary to manually retract and extend conventional trolling motors.

Electrically operated trolling motors are enjoying increasing popularity in such outdoor boating activities as fishing and particularly in trolling, when low speed, relatively silent boat operation is desired. These motors are easily mounted on a boat and the retractable models are usually secured to the bow of a boat such that they can be withdrawn from the water and retained inside the boat on a support bracket in retracted position when the boat is propelled at normal speeds by an outboard, inboard-outboard or jet propulsion system. As a matter of convenience, the motor mount of an electric trolling motor should be arranged in such a manner as to afford movement of the motor between a retracted or storage position and an extended or operating position with a minimum of effort and without having to manually adjust the position of the motor. Such a folding bracket system is usually mounted on a horizontal deck area at the forward end of the watercraft and a typical mounting includes a pivotal mount bracket assembly which permits depending of the motor unit from the front of the boat in vertical orientation for low speed propulsion of the boat. Alternatively, the trolling motor unit can be raised from the propulsion configuration and placed in the transport position across the deck by manual operation and retraction of folding bracket systems designed to accomplish this purpose.

2. Description of the Prior Art

Various types of retractable trolling motors and brackets therefor are known in the art. Typical of these mounting systems is the "Electrically Operated Bow Mount For Trolling Motor" disclosed in U.S. Pat. No. 3,980,039, dated Sept. 14, 1976, to Andrew R. Henning. The trolling motor disclosed in this patent is mounted on a plate which is detachably supported on the bow or deck of a boat. A gear driven by an electric motor is mounted on the mounting plate and meshes with a rack on the motor tube or shaft, to raise and lower the trolling motor in the vertical position. Raising of the motor shaft to a predetermined position trips a latch on the plate and allows the motor shaft to rotate bodily with the gear to a horizontal stowed position on the boat. U.S. Pat. No. 3,948,472, dated Apr. 6, 1976, entitled "Mounting Arrangement For Small Outboard Motors" to Silas L. Metcalf, discloses an outboard motor mounting arrangement which includes first and second links pivotally connected to a bracket. The bracket is adapted to support an outboard motor and pivotally attaches to a member which is adapted to be mounted on a boat hull for pivotal movement of the bracket relative to the member between a storage position and an operating position. A tension spring is connected between the links in order to releasably urge the engine support bracket toward the operation position. The links are arranged such that the support bracket moves substantially vertically during initial movement from the operating position toward the stored position to reduce the effort required to raise the outboard motor from the water. A "Pivotal Mount Assembly For Trolling Motors" is disclosed in U.S. Pat. No. 4,008,680, dated Feb. 26, 1977, to Charles F. Alexander, Jr. This assembly device includes a deck bracket having a housing arm pivotally mounted at one end and a gear mechanism located inside the arm has a fixed bevel gear on the pivot arm axis, which bevel gear meshes with a corresponding bevel gear on a rotatable torque tube. A drive bevel gear is secured to the opposite end and meshes with a gear sector on a coupling head pivotally mounted in the outer end of the arm. The head includes a swivel support within which the trolling motor unit is rotatably mounted. The coupling head and motor unit are located between a depending propulsion position and a transport position in response to the 180° swinging of the pivot arm. The torque arm is coupled to the bevel gears by sliding couplings and is coupled to a locking device for the arm and for the gear sector in order to lock these members in the propulsion position and simultaneously release them for raising to the transport position. U.S. Pat. No. 3,580,212, dated May 25, 1971, to Warren D. Fortson, discloses a "Control and Mounting Systems for Electric Trolling Motor" which includes remotely disposed power and steering controls. The storage housing is constructed in a manner whereby a battery for the electric outboard motor assembly may be received therein and a voltage control is mounted on the housing and is operatively connected to the battery and electric motor of the outboard motor assembly, for controlling the speed of operation of the electric motor. The steering control for the outboard motor assembly includes a pair of selectively usable steering components, one of which is removably supported from the housing and is receivable in the housing for storing and the other of which is mountable directly on the outboard motor assembly and is also receivable in the housing for storage. The second mentioned steering control is provided with its own voltage control, whereby onehand operation of the electric outboard motor assembly may be accomplished when the motor is being steered by the second steering control. U.S. Pat. No. 4,371,144 dated Feb. 1, 1983, entitled "Motor Securing Device for Watercraft" to Harry H. Godlewski, discloses a motor securing device for watercraft such as inflatable boats and rafts. The device includes a generally downwardly open securing portion which is defined by a pair of parallel walls and a connecting wall. A motor attachment portion projects generally upwardly from a rear portion of the secured section and a battery-securing shelf extends forwardly from the securing portion for securing a motor to the upwardly projecting wall. A battery positioned on the supporting shelf provides a counter-balancing action and retaining structures may also be provided to resist undesired displacement of the battery or motor-securing clamp. U.S. Pat. No. 2,901,194, dated Aug. 25, 1959, to H. W. Shontz, discloses an "Outboard Motor Lift". The outboard motor lift of this invention is characterized by a spring-loaded, folding lift arm assembly, one end of which is attached to the outboard motor and the other end extending inwardly of the boat to a brace. When it is desired to move the outboard motor from an outboard position on the transom inwardly of the boat, the motor is loosened from the transom and pulled forwardly, where it is pivoted on the linkage assembly to a position inwardly of the boat.

One of the problems which is inherent in conventional retractable trolling motor systems is the requirement of applying considerable pressure and force to the trolling motor in order to raise it from a deployed to a stored or retracted configuration on the deck of a boat. Furthermore, the raising and lowering mechanism is frequently complex in design and subject to malfunction and breakage. Accordingly, it is an object of this invention to provide a new and improved retractable trolling motor assembly which is mounted on the bow or deck of a boat and is electrically operated to automatically and selectively deploy the trolling motor into a vertical operating position and a horizontal retracted position.

Another object of the invention is to provide a novel electrically operated bow-mounted trolling motor assembly which employs a simple and easily operated folding mechanism to achieve selective retraction and extension of a trolling motor into stored and deployed configuration, respectively.

Still another object of the invention is to provide a threaded screw-operated, retractable trolling motor assembly for selectively raising an electric trolling motor into the vertical operating position and retracting the motor into a horizontal, stored configuration on a boat deck.

Yet another object of this invention is to provide a new and improved retractable trolling motor assembly which is characterized by a fixed glide track mounted to the bow of a boat, a slide bracket slidably attached to the glide track and threadably engaging a threaded drive shaft which is rotatably journaled in the glide track and a trolling motor bracket pivotally attached to the slide bracket and carrying the shaft of a trolling motor, wherein the trolling motor is selectively positioned in a retracted configuration horizontally positioned on the glide track and in a functional, vertical extended and deployed configuration with the propulsion unit positioned in the water, by electrical operation of the drive shaft and traverse of the slide bracket along the glide track.

SUMMARY OF THE INVENTION

These and other objects of the invention are provided in a new and improved retractable trolling motor assembly which is characterized by a glide track mounted to the bow or deck of a boat, a slide bracket slidably positioned on the glide track and threadably cooperating with a threaded drive shaft operated by an electric motor and journalled for rotation in the glide track and a trolling motor bracket pivotally attached to the slide bracket. Stabilizing shock absorbers extend between the trolling motor bracket and the slide bracket and a trolling motor shaft is secured in the trolling motor bracket, wherein the trolling motor is selectively positioned in a vertical, operational configuration forward of the bow of the boat and in a horizontal, retracted configuration on the glide track by operation of the electric motor and rotation of the drive shaft.

BRIEF DESCRIPTION OF THE DRAWINGS

The invention will be better understood by reference to the accompanying drawings, wherein:

FIG. 1 is a perspective view of a preferred embodiment of the retractable trolling motor assembly with the trolling motor oriented in functional, vertically deployed configuration;

FIG. 2A is a longitudinal sectional view of the glide track taken along line 2A—2A of the retractable trolling motor assembly illustrated in FIG. 1;

FIG. 2B is a side elevation, partially in section, of the retractable trolling motor assembly illustrated in FIG. 1, more particularly illustrating the trolling motor in retracted, horizontal configuration;

DESCRIPTION OF THE PREFERRED EMBODIMENTS

Figure 3:
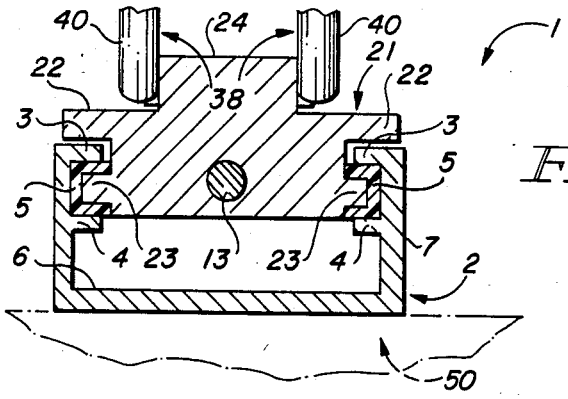
FIG. 3 is a transverse sectional view of the glide track and slide bracket taken along line 3—3 of the retractable trolling motor assembly illustrated in FIG. 1.

Referring initially to FIGS. 1, 2A and 3–6 of the drawings the retractable trolling motor assembly of this invention is generally illustrated by reference numeral 1. The retractable trolling motor assembly 1 is characterized by a glide track 2 which is secured by fasteners such as bolts or screws (not illustrated) to a flat boat deck 50 (illustrated in phantom) and is further characterized by a flat track base 6 with upward standing, parallel track sides 7 projecting therefrom. Each of the upward standing track sides 7 is fitted with oppositely disposed, inwardly projecting, parallel top track flanges 3 and facing, parallel bottom track flanges 4 which are spaced from the top track flanges 3, respectively, as illustrated in FIG. 3. A motor support 12, having parallel support flanges 20, is secured to the projecting end of the glide track 2 by means of fasteners such as screws or bolts (not illustrated). These fasteners connect the front segment 10*a* of the split brace 10 to the rear segment 10*b*, which rear segment 10*b* is secured to or molded integrally with the glide track 2 and the front segment 10*a* is secured to or molded integrally with the motor support 12. A track notch 8 is provided in each of the support flanges 20 of the motor support 12 and the track notches 8 are characterized by rounded contact surfaces 9. As illustrated in FIGS. 1 and 2A the split brace 10 spans the track sides 7 and support flanges 20 rearwardly of the notches 8 and a rear brace 11 spans the track sides 7 toward the rear end of the glide track 2. As further illustrated in FIG. 3 of the drawings a track insert 5 is fitted between each of the respective sets of facing top track flanges 3 and bottom track flanges 4 of the glide track 2 and the parallel tracks 5 slidably receive the projecting bottom bracket slides 23 of a slide bracket 21. The slide bracket 21 is further provided with a pair of extending top bracket slides 22 which overhang but do not touch the respective top track flanges 3 of the glide track 2. Accordingly, it will be appreciated that the slide bracket 21 is slidably mounted in the facing track inserts 5 and is designed to traverse the glide track 2 in both directions, as hereinafter described. In a most preferred embodiment of the invention the slide bracket 21 is further provided with an upward-standing cylinder mount 24, the front end of which cylinder mount 24 projects beyond the top bracket slide 22 toward the track notches 8. A threaded drive shaft 13 is rotatably positioned in a front base bearing 15, located in the rear segment 10*b* of the split brace 10 and a rear brace bearing 16 is located in the rear brace 11 and receives the opposite end of the drive shaft 13, which is coupled to the motor shaft 19 of an electric motor 17 by means of a coupling 18, as illustrated in FIGS. 1 and 2A. The drive shaft 13 is provided with shaft threads 14 along substantially the entire length thereof and the motor 17 is reversible in operation, such that the drive shaft 13 can be rotated in either the clockwise or counterclockwise direction in the front brace bearing 15 and rear brace bearing 16 responsive to appropriate switch means (not illustrated). Accordingly, it will be appreciated from a consideration of FIGS. 1, 2A and 3 that the slide bracket 21 is capable of traversing the glide track 2 in the forward and reverse direction by operation of the drive shaft 13.

Referring again to FIGS. 1 and 2, 4–6 of the drawings a trolling motor bracket 26 having a bracket slot 31 is pivotally attached to the extending frontal portion of the cylinder mount 24 by means of spaced bottom bracket flanges 28, which extend from the trolling motor bracket 26 and a bottom bracket pin 30, which projects through registering openings (not illustrated) provided in the bottom bracket flanges 28 and the cylinder mount 24. In a most preferred embodiment of the invention a pair of shock absorbers 38 extend between spaced top bracket flanges 27 projecting from the trolling motor bracket 26 and the opposite end of the cylinder mount 24. In a preferred installation, the cylinders 40 of the shock absorbers 38 are pivotally connected by means of cylinder pins 41 to opposite sides of the cylinder mount 24 while the pistons 39, which extend into the cylinders 40, respectively, are pivotally secured at the opposite ends thereof to the top bracket flanges 27 by the top bracket pins 29, as illustrated. As further illustrated in FIG. 6 of the drawings in yet another preferred embodiment of the invention a bracket hinge 25, provided in the trolling motor bracket 26 opposite the bracket slot 31, serves to open and close the half bracket clamps 26*a* and 26*b*, to facilitate fitting the trolling motor bracket 26 on the trolling motor shaft 42 of the trolling motor 43. Accordingly, referring again to FIG. 6 of the drawings, it will be appreciated that the trolling motor bracket 26 can be mounted on the trolling motor shaft 42 by simply turning the adjusting bolt handle 36 and removing the adjusting bolt 34 to open the respective sides of the trolling motor bracket 26 on the bracket hinge 25. It will be further appreciated that the trolling motor bracket 26 is adjustably and slidably positioned on the trolling motor shaft 42 by operation of the adjusting bolt handle 36 and handle neck 37 against the adjustment flange 32, which is mounted on the trolling motor bracket 26, wherein the adjusting bolt threads 35 in the adjusting bolt 34 are threadably inserted in the receiving flange 33, also secured to the trolling motor bracket 26.

Figure 4:
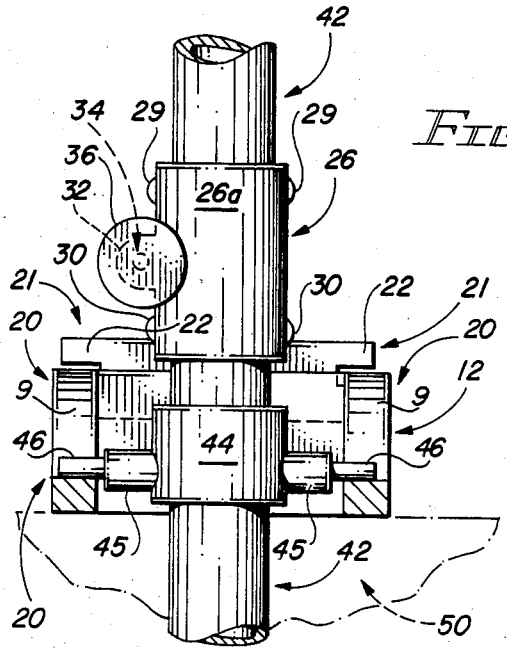
FIG. 4 is a transverse sectional view taken along line 4—4 of the retractable trolling motor assembly illustrated in FIG. 1.
Figure 5:
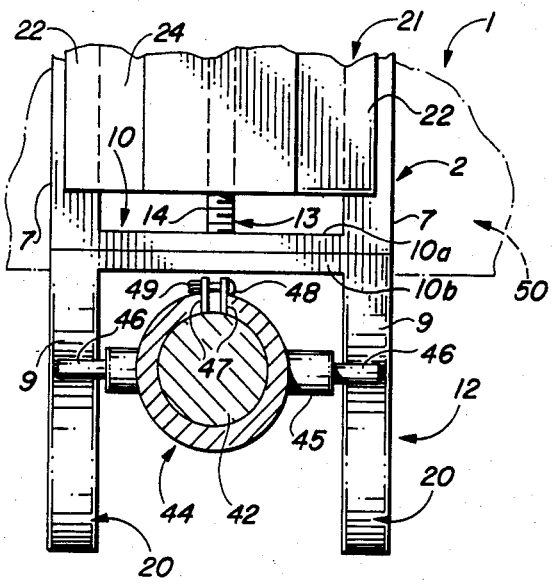
FIG. 5 is a longitudinal sectional view of the trolling motor shaft and shaft collar, taken along line 5—5 of the retractable trolling motor assembly illustrated in FIG. 1.
Figure 6:
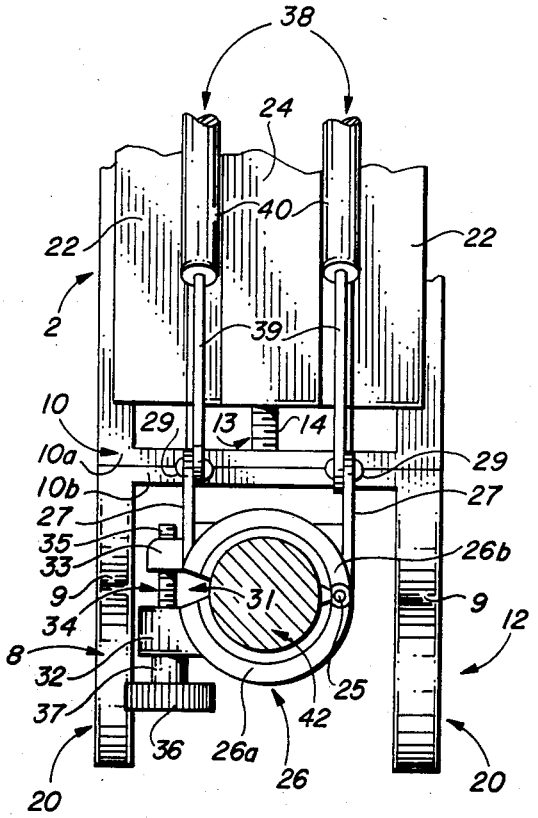
FIG. 6 is a top elevation, partially in section, of the retractable trolling motor assembly illustrated in FIG. 1 with the shaft collar removed for illustration purposes.

Referring now to FIGS. 2A, 4 and 5 of the drawings it will be appreciated that a shaft collar 44 is secured to the trolling motor shaft 42 beneath the trolling motor bracket 26 by means of a pair of collar brackets 47 and a cooperating collar bracket bolt 48 and nut 49, as illustrated in FIG. 5. A pair of collar pin mounts 45 extend in oppositely disposed relationship from the shaft collar 44 and carry round shear pins 46, which seat in the bottom of the track notch 8 as illustrated in FIGS. 1, 4 and 5 when the retractable trolling motor assembly 1 is in deployed configuration.

In operation, referring again to FIGS. 1, 2A and 2B of the drawings, when it is desired to retract the trolling motor 43 from the functional operating configuration illustrated in FIGS. 1 and 2A to the retracted configuration illustrated in FIG. 2B, the drive shaft 13 is initially operated in the clockwise configuration as viewed from the motor 17 by appropriate switching (not illustrated) provided in cooperation with the motor 17. This action causes the slide bracket 21 to move rearwardly toward the motor 17 and to initially pull the trolling motor shaft 42 and trolling motor 43 into an angled configuration as illustrated in phantom in FIG. 2B, as the shear pins 46 exit the track notches 8 and traverse the contact surfaces 9 of the support flanges 20 in the motor support 12. Continued rotation of the drive shaft 13 in the clockwise direction causes the slide bracket 21 to continue its movement toward the motor 17 until the pistons 39 of the shock absorbers 38 are retracted in the cylinders 40 and the trolling motor shaft 42 and the trolling motor 43 are in the fully retracted configuration, as illustrated in FIG. 2B. Deployment of the trolling motor 43 back into the operational configuration illustrated in FIG. 1 is accomplished by simply reversing the direction of rotation of the drive shaft 13 by again switching the motor 17 and causing the drive shaft 13 to rotate in the counter-clockwise direction as viewed from the motor 17. This action causes the slide bracket 21 to move in the opposite direction toward the track notches 8 and the trolling motor shaft 42 and trolling motor 43 to traverse the glide track 2 in the opposite direction, until the shear pins 46 again traverse the contact surfaces 9 of the support flanges 20 as the trolling motor shaft 42 again assumes the position illustrated in phantom in FIG. 2B. Continued movement of the slide bracket 21 in the same direction causes the shear pins 46 to again seat in the track notches 8, respectively, and deploy the trolling motor shaft 42 and trolling motor 43 in the vertical, operational configuration illustrated in FIGS. 1 and 2A. Controlled retraction and extension of the pistons 39 to and from the cylinders 40 in the shock absorbers 38 serves to insure smooth operation of the trolling motor extension and retraction.

Referring again to FIGS. 1, 2B and 4–6 of the drawings in a most preferred embodiment of the invention the motor support 12 is constructed of a non-metallic, tough, impact-resistant material such as nylon, in order to provide a resilient, yet durable travel surface and seat for the shear pins 46. Furthermore, it will be appreciated by those skilled in the art that the shaft collar 44 is easily removed from the trolling motor shaft 42 and a new shaft collar 44 installed, if one or both of the shear pins 46 are sheared from the corresponding collar pin mounts 45 when the trolling motor shaft 42 or the submerged propulsion unit (not illustrated) strikes an underwater obstacle. This feature prevents damage to the drive unit and trolling motor shaft 42 in such an event. Furthermore, as illustrated in FIGS. 1 and 2A the trolling motor shaft 42 is vertically adjustable with respect to the glide track 2 and boat deck 50 for shallow or deep operation of the trolling motor propulsion unit, by adjustment of the adjusting bolt handle 36.

While the preferred embodiments of the invention have been described above, it will be recognized and understood that various modifications may be made therein and the appended claims are intended to cover all such modifications which may fall within the spirit and scope of the invention.

Having described my invention with the particularity set forth above, what is claimed is:

1. A retractable trolling motor assembly for selectively raising and lowering a trolling motor with respect to a boat, said retractable trolling motor assembly comprising track means mounted on the boat; a threaded drive shaft journalled for rotation in said track means; a slide bracket slidably received by said track means, said slide bracket threadibly engaging said threaded drive shaft; bracket means carrying the trolling motor, said bracket means pivotally attached to said slide bracket; a motor support terminating one end of said track means; a pair of track notches provided in said motor support; and shear pin means carried by the trolling motor, said shear pin means adapted for seating in said track notches when the trolling motor is vertically suspended from said track means, whereby the trolling motor is selectively horizontally retracted on said track means and vertically suspended from said track notches responsive to forward and reverse rotation of said threaded drive shaft.

2. The retractable trolling motor assembly of claim 1 further comprising drive means attached to one end of said threaded drive shaft for rotating said threaded drive shaft in a selected direction.

3. The retractable trolling motor assembly of claim 2 wherein said drive means is an electric motor.

4. The retractable trolling motor assembly of claim 1 further comprising at least one shock absorber extending between said bracket means and said slide bracket.

5. The retractable trolling motor assembly of claim 1 further comprising:

(a) drive means attached to one end of said threaded drive shaft for rotating said threaded drive shaft in a selected direction; and (b) at least one shock absorber extending between said bracket means and said slide bracket.

6. The retractable trolling motor assembly of claim 5 wherein said drive means is an electric motor.

7. The retractable trolling motor assembly of claim 6 wherein said at least one shock absorber is a pair of shock absorbers disposed in spaced, substantially parallel relationship between said bracket means and said slide bracket, each of said shock absorbers having a cylinder pivotally carried by said slide bracket and a piston slidably engaging said cylinder, said piston pivotally attached to said bracket means.

8. The retractable trolling motor assembly of claim 7 wherein said shear pin means further comprises a collar clamped on the trolling motor beneath said bracket means and a pair of shear pins projecting in fixed relationship from said collar, with said shear pins engaging said track notches.

9. The retractable trolling motor assembly of claim 8 wherein said bracket means further comprises a pair of half bracket clamps, a hinge connecting said half bracket clamps at one edge thereof and an adjusting bolt threadibly engaging one of said half bracket clamps and rotatably projecting through the other of said half bracket clamps at the opposite edge of said half bracket clamps for adjustably tightening said half bracket clamps on the trolling motor.

10. A retractable trolling motor assembly for selectively retracting and extending a trolling motor provided with a trolling motor shaft, said retractable trolling motor assembly comprising track means mounted on the deck of a boat; a threaded drive shaft longitudinally journalled for rotation in said track means; a slide bracket slidably received by said track means, said slide bracket threadibly engaging said threaded drive shaft; bracket means carrying the shaft of the trolling motor, said bracket means pivotally attached to said slide bracket; drive means coupled to one end of said threaded drive shaft for rotating said threaded drive shaft in a selected direction; a motor support terminating one end of said track means; a pair of track notches provided in said motor support; and shear pin means carried by the trolling motor shaft, said shear pin means adapted for seating in said track notches when the trolling motor is vertically suspended from said track means, whereby the trolling motor is selectively horizontally retracted on said track means and vertically suspended from said track notches responsive to rotation of said threaded drive shaft by said drive means.

11. The retractable trolling motor assembly of claim 10 further comprising at least one shock absorber extending between said bracket means and said slide bracket.

12. The retractable trolling motor assembly of claim 11 wherein said at least one shock absorber is a pair of shock absorbers disposed in spaced, substantially parallel relationship between said bracket means and said slide bracket, each of said shock absorbers having a cylinder pivotally carried by said slide bracket and a piston slidably engaging said cylinder, said piston pivotally attached to said bracket means.

13. The retractable trolling motor of claim 12 wherein said shear pin means further comprises a collar clamped on the trolling motor shaft beneath said bracket means and a pair of shear pins projecting in fixed relationship from said collar, with said shear pins engaging said track notches.

14. The retractable trolling motor of claim 13 wherein said bracket means further comprises a pair of half bracket clamps, a hinge connecting said half bracket clamps at one edge thereof, and an adjusting bolt threadibly engaging one of said half bracket clamps and rotatably projecting through the other of said half bracket clamps at the opposite edge of said half bracket clamps for adjustably tightening said half bracket clamps on the trolling motor shaft.

15. A retractable trolling motor assembly for mounting on the deck of a boat and selectively raising and lowering a trolling motor provided with an elongated trolling motor shaft, said retractable trolling motor assembly comprising an elongated track mounted on the deck of the boat; a threaded drive shaft longitudinally journalled for rotation in said track; a slide bracket slidably carried by said track, said slide bracket threadibly engaging said threaded drive shaft; a bracket adjustably carried by the trolling motor shaft, said bracket pivotally attached to said slide bracket; a motor support terminating one end of said track; a pair of track notches provided in said motor support; and shear pin means carried by the trolling motor shaft, said shear pin means adapted for seating in said track notches when the trolling motor is extended on said track; and an electric motor having a motor shaft coupled to one end of said threaded drive shaft for rotating said threaded drive shaft in a selected direction, whereby the trolling motor is selectively raised and retracted on said track and extended on said track to said motor support and said track notches and lowered responsive to rotation of said threaded drive shaft by said electric motor.

16. The retractable trolling motor assembly of claim 15 further comprising a pair of shock absorbers disposed in spaced, substantially parallel relationship between said bracket means and said slide bracket, each of said shock absorbers having a cylinder pivotally carried by said slide bracket and a piston slidably engaging said cylinder, said piston pivotally attached to said bracket means.

17. The retractable trolling motor assembly of claim 16 wherein said shear pin means further comprises a collar clamped on the trolling motor shaft beneath said bracket means and a pair of shear pins projecting in fixed relationship from said collar, with said shear pins engaging said track notches.

18. The retractable trolling motor assembly of claim 17 wherein said bracket means further comprises a pair of half bracket clamps, a hinge connecting said half bracket clamps at one edge thereof, and an adjusting bolt threadibly engaging one of said half bracket clamps and rotatably projecting through the other of said half bracket clamps at the opposite edge of said half bracket clamps for adjustably tightening said half bracket clamps on the trolling motor shaft.

* * * * *